US009765786B2

(12) United States Patent
Korpela

(10) Patent No.: US 9,765,786 B2
(45) Date of Patent: Sep. 19, 2017

(54) PRESSURE-INCREASING UNIT

(71) Applicant: Samuli Korpela, Kauhajoki (FI)

(72) Inventor: Samuli Korpela, Kauhajoki (FI)

(73) Assignee: BF+ ENERGIA OY, Tampere (FI)

( * ) Notice: Subject to any disclaimer, the term of this patent is extended or adjusted under 35 U.S.C. 154(b) by 87 days.

(21) Appl. No.: 14/422,431

(22) PCT Filed: Aug. 16, 2013

(86) PCT No.: PCT/FI2013/050810
§ 371 (c)(1),
(2) Date: Feb. 19, 2015

(87) PCT Pub. No.: WO2014/029912
PCT Pub. Date: Feb. 27, 2014

(65) Prior Publication Data

US 2015/0219103 A1 Aug. 6, 2015

(30) Foreign Application Priority Data

Aug. 20, 2012 (FI) ..... 20124166 U

(51) Int. Cl.
*F04D 13/16* (2006.01)
*F02G 1/00* (2006.01)
(Continued)

(52) U.S. Cl.
CPC ..... *F04D 13/16* (2013.01); *F02G 1/00* (2013.01); *F04B 41/00* (2013.01); *F17D 1/04* (2013.01); *Y10T 137/3127* (2015.04)

(58) Field of Classification Search
CPC ..... F02G 1/045; F17D 1/04; F04D 13/16
(Continued)

(56) References Cited

U.S. PATENT DOCUMENTS 3,846,049 A * 11/1974 Douglas ..... F01L 25/06 417/404
3,951,199 A * 4/1976 Pereira ..... B22D 18/08 164/119

(Continued)

FOREIGN PATENT DOCUMENTS

DE 102004001917 A1 2/2005
EP 2196338 A1 6/2010

(Continued)

OTHER PUBLICATIONS

International Search Report dated Oct. 16, 2013 from the International Bureau in counterpart International Application No. PCT/FI2013/050810.

(Continued)

*Primary Examiner* — Craig Schneider
*Assistant Examiner* — Angelisa L Hicks
(74) *Attorney, Agent, or Firm* — Sughrue Mion, PLLC

(57) ABSTRACT

The present invention relates to a pressure-increasing unit (1) comprising first receiving means (2) for receiving a pipeline (4) conveying pressurized gas, at least one first pipeline (3) for further transferring the pressurized gas to applications utilizing it, and second receiving means (6) for receiving a second pipeline (5) conveying reduced-pressure gas returning from the applications. The present solution is characterized in that the receiving means (6) are connected with at least one pressure intensifier (7). This pressure intensifier, in turn, is connected to the first receiving means (2) receiving pressurized gas for transferring gas re-pressurized by a substitution means (8) back to the applications utilizing it.

8 Claims, 2 Drawing Sheets

(51) Int. Cl.
*F04B 41/00* (2006.01)
*F17D 1/04* (2006.01)

(58) Field of Classification Search
USPC ..... 137/571, 572, 209
See application file for complete search history.

(56) References Cited

U.S. PATENT DOCUMENTS

| | | | | |
|---|---|---|---|---|
| 4,483,142 | A * | 11/1984 | Tsunekawa | F02G 1/05 60/517 |
| 4,612,769 | A | 9/1986 | Berntell | |
| 4,655,036 | A | 4/1987 | Hindes | |
| 2004/0123909 | A1* | 7/2004 | Parkkinen | F04B 41/00 137/563 |
| 2010/0205960 | A1* | 8/2010 | McBride | F02C 6/16 60/641.2 |

FOREIGN PATENT DOCUMENTS

| | | | |
|---|---|---|---|
| GB | 1383860 | A | 2/1975 |
| GB | 2469852 | A | 11/2010 |
| WO | 02068858 | A1 | 9/2002 |

OTHER PUBLICATIONS

Communication dated Jun. 9, 2016, from the European Patent Office in counterpart European application No. 13830803.6.

* cited by examiner

PRESSURE-INCREASING UNIT

CROSS REFERENCE TO RELATED APPLICATIONS

This application is a National Stage of International Application No. PCT/FI2013/050810 filed Aug. 16, 2013, claiming priority based on Finnish Patent Application No. U20124166, filed Aug. 20, 2012, the contents of all of which are incorporated herein by reference in their entirety.

BACKGROUND OF THE INVENTION

The present invention relates to a pressure-increasing unit as claimed in the preamble of claim 1. Such a device is utilized in a pressurized gas system in particular, such a system comprising at least one compressor. The system further includes a suction pipe connected to the compressor for gas input, and an output pipe for gas pressurized by the compressor. The output pipe is connected to a distribution pipeline through which gas is distributed to objects of use, such as blow couplings and actuator couplings, provided in an operating space.

In previously known systems, the gas used therein always has to be dried and otherwise purified prior to allowing the gas to enter the distribution pipeline in order to enable possible malfunctions in the objects of use to be avoided. Moisture removal, for instance, causes relatively high costs, which are further increased by the fact that in an ordinary system the pressurized gas is allowed to be discharged into the space surrounding the object of use. Consequently, all pressurized gas used in the system always has to be dried, and it has to be pressurized to the pressure level of the system from normal atmospheric pressure.

BRIEF DESCRIPTION OF THE INVENTION

An object of the invention is thus to provide an apparatus enabling the aforementioned problems relating to pre-treatment of pressurized gas to be mainly solved. This object is achieved such that the pressure-increasing unit is, according to the present invention, provided with the characteristic features defined in the claims. More specifically, the device according to the invention is mainly characterized by what is disclosed in the characterizing part of claim 1.

Preferred embodiments of the invention are disclosed in the dependent claims.

The invention is based on the idea that gas with reduced pressure in the object of use is recovered for recycling. For this purpose, a particular pressure-increasing unit operating in the immediate vicinity of the object of use is connected to the pressurized gas system for treating recovered gas.

The invention provides considerable advantages. Thus the device, which also as auxiliary equipment is readily installable in a system using pressurized gas, such as pressurized air, may be used separately from the actual pressurization main unit in order to increase the pressure of the gas locally. This enables the laborious and resource-demanding purification and drying required by continuous new gas to be pressurized to be avoided. The device thus enables gas pressurization costs to be reduced significantly.

By using the arrangement according to the invention to be provided in connection with the object of use or in the vicinity thereof, solutions can be avoided wherein pressurized gas to be possibly recovered is conveyed, by using parallel and expensive pipelines, to the primary compressor of the system for re-pressurization.

When made sufficiently compact, the arrangement is easy to take directly to the object of use and connect it therein to the pressure line of gas-utilizing applications.

Other advantages of the invention are presented in the following in connection with a more detailed description of special embodiments of the invention.

BRIEF DESCRIPTION OF THE FIGURES

In the following, some preferred embodiments of the invention will be explained in closer detail with reference to the accompanying drawing, in which.

DETAILED DESCRIPTION OF A PREFERRED EMBODIMENT

Figure 1:
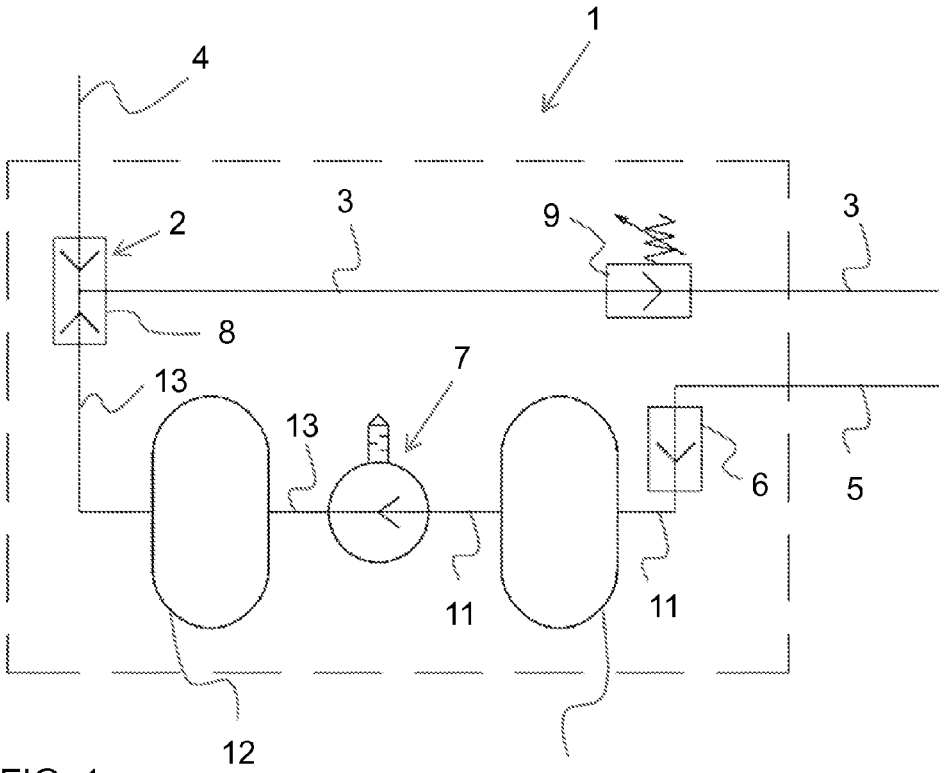
FIG. 1 shows a schematic structure of a pressure-increasing unit.

The present figures do not show the pressure-increasing unit in scale but the figures are schematic, illustrating the structure and operation of the preferred embodiment in principle. The most essential structural parts of the solution indicated by reference numerals in the attached figures then correspond to the structural parts marked with reference numerals in this specification.

A pressure-increasing unit 1 according to FIGS. 1 to 4 most preferably comprises first receiving means 2 arranged to receive and guide pressurized gas further to at least one first pipeline 3 through which the pressurized gas is conveyed to applications utilizing it; no such applications are separately shown in this connection. Typically, the pressurized gas is conveyed to the pressure-increasing unit along a pipeline 4 from a main source, such as one or more compressors, known per se and omitted from this description.

Reduced-pressure gas that passes through devices using pressurized gas, such as pressurized air, is recovered in manners known per se and directed to a second pipeline 5 along which it is conveyed to second receiving means 6. These second receiving means 6 for receiving reduced-pressure gas preferably comprise a non-return valve arranged in the second pipeline, such as a check valve known per se.

Recycling the reduced-pressure gas for reuse requires that the pressure of the gas be increased, which in the present pressure-increasing unit is solved by conveying the gas to at least one pressure intensifier 7 connected to a check valve. By utilizing energy contained in a gas flow, gas having a pressure higher than therebefore is produced in the gas intensifier, and the gas is led to a substitution means 8 which is connected to the pressure intensifier and which may be a change valve, e.g. a shuttle valve, placed between the pipeline 4 conveying pressurized gas and the first pipeline 3 further transferring the pressurized gas to the applications utilizing it. In its preferred embodiment, the substitution means forms simultaneously the first receiving means 2. When the pressure of the gas pressurized by the pressure intensifier is higher than the pressure of the gas coming from the main source along the pipeline 4, re-pressurized gas moves through the substitution means along the first pipeline to the applications while the substitution means simultaneously cuts off the flow coming from the main source.

The first pipeline 3 may also be provided with a pressure controller 9 which, when necessary, adjusts the pressure of the re-pressurized gas to be the same as the pressure of the gas coming from the main source.

By providing the pressure-increasing unit 1 with a first storage tank 10, it is possible to store the reduced-pressure gas coming from the applications in order to produce amounts of gas sufficient for the treatment. Such a first storage tank is for this purpose arranged in a third pipeline 11 interconnecting the receiving means 6 receiving the reduced-pressure gas and the first pressure intensifier.

The pressure-increasing unit may also be provided with a second storage tank 12 arranged in a fourth pipeline 13 interconnecting one or more pressure intensifiers 7 and the substitution means 8. Such a storage tank may be utilized either together with the aforementioned first storage tank or irrespective thereof. By conveying from the pressure intensifier the re-pressurized gas to the second storage tank, it is possible to store the gas therein until its pressure is higher than the pressure of the gas coming from the main source, after which it may be directed to the substitution means and further to the applications.

Figure 2:
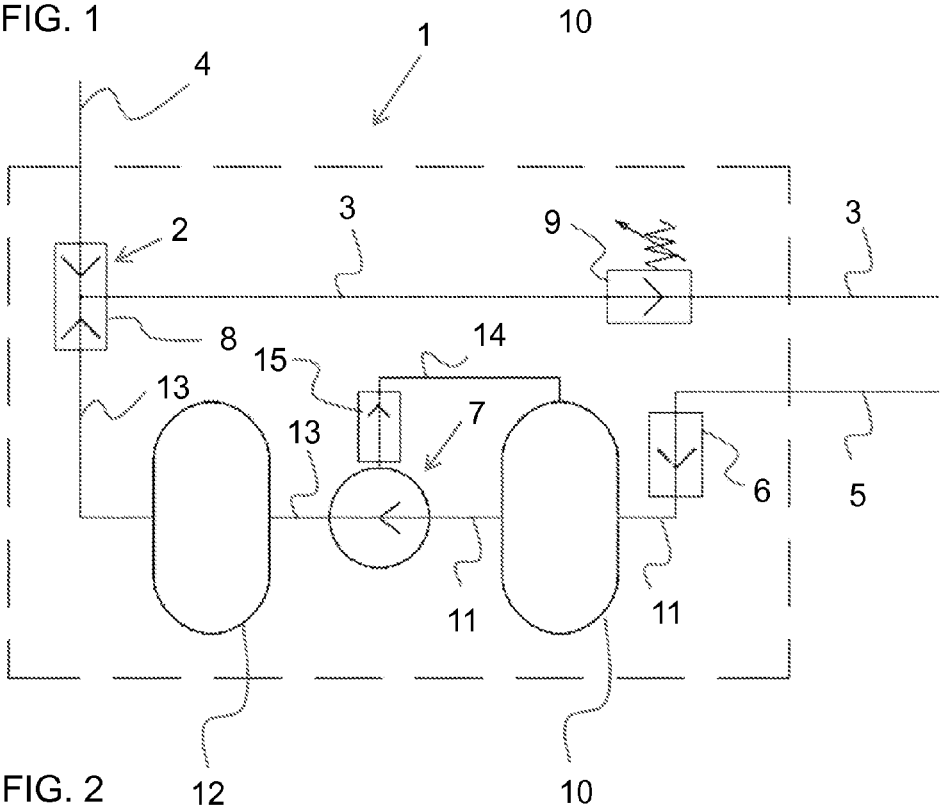
FIG. 2 shows a schematic structure of a second embodiment of the pressure-increasing unit.

In another embodiment, the pressure-increasing unit 1 comprises a return line 14 arranged in the pressure intensifier 7 for conveying the pressurized gas that released energy in the pressure intensifier back to the first storage tank 10. Such an embodiment is shown in FIG. 2. Preferably, the return line is provided with a check valve 15 for preventing flow to the pressure intensifier this way. By recovering this pressurized gas that has released energy, it is possible to efficiently utilize even the last energy content remaining therein.

Figure 3:
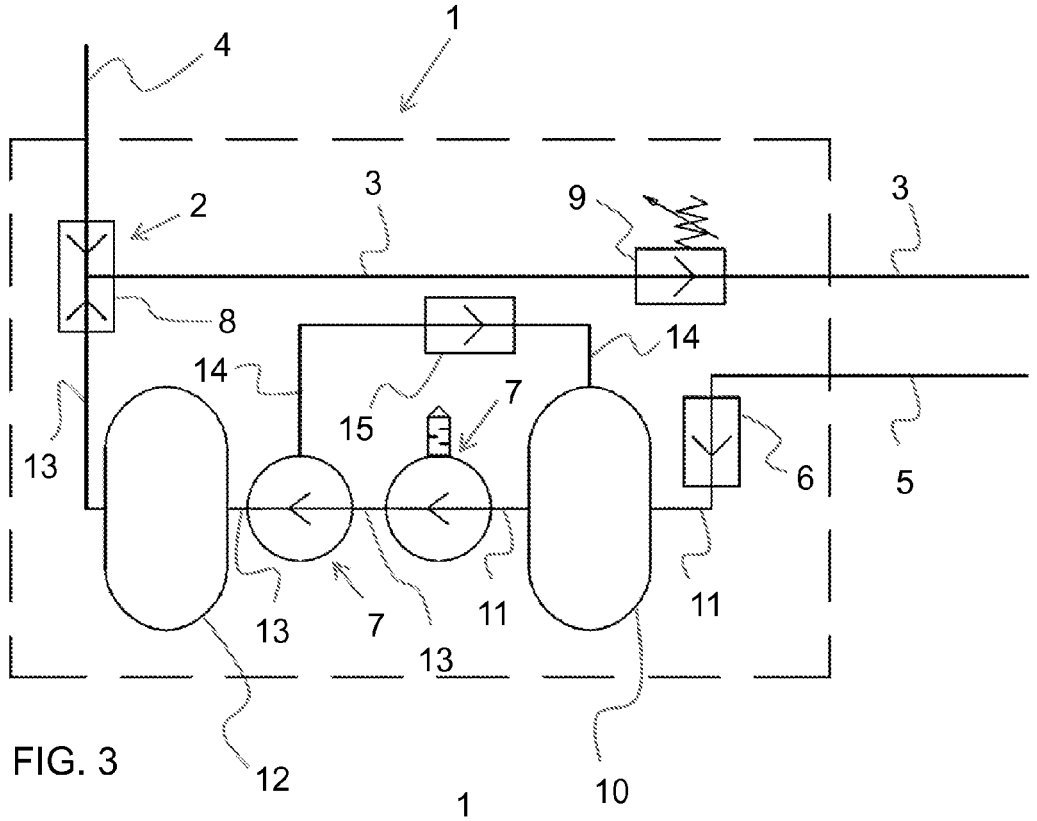
FIG. 3 shows a schematic structure of a third embodiment of the pressure-increasing unit.

A variation of this embodiment is shown in the embodiment according to FIG. 3, wherein the pressure-increasing unit 1 comprises two successive pressure intensifiers 7 arranged in series. In this embodiment, the return line 14 for conveying the pressurized gas that has released energy from the pressure intensifier back to the first storage tank 10 is arranged in the latter pressure intensifier. Thus, the pressure of the gas is intensified twice, and the operating pressure is conveyed via the check valve 15 to the first storage tank, in which case it is also available for utilization.

Figure 4:
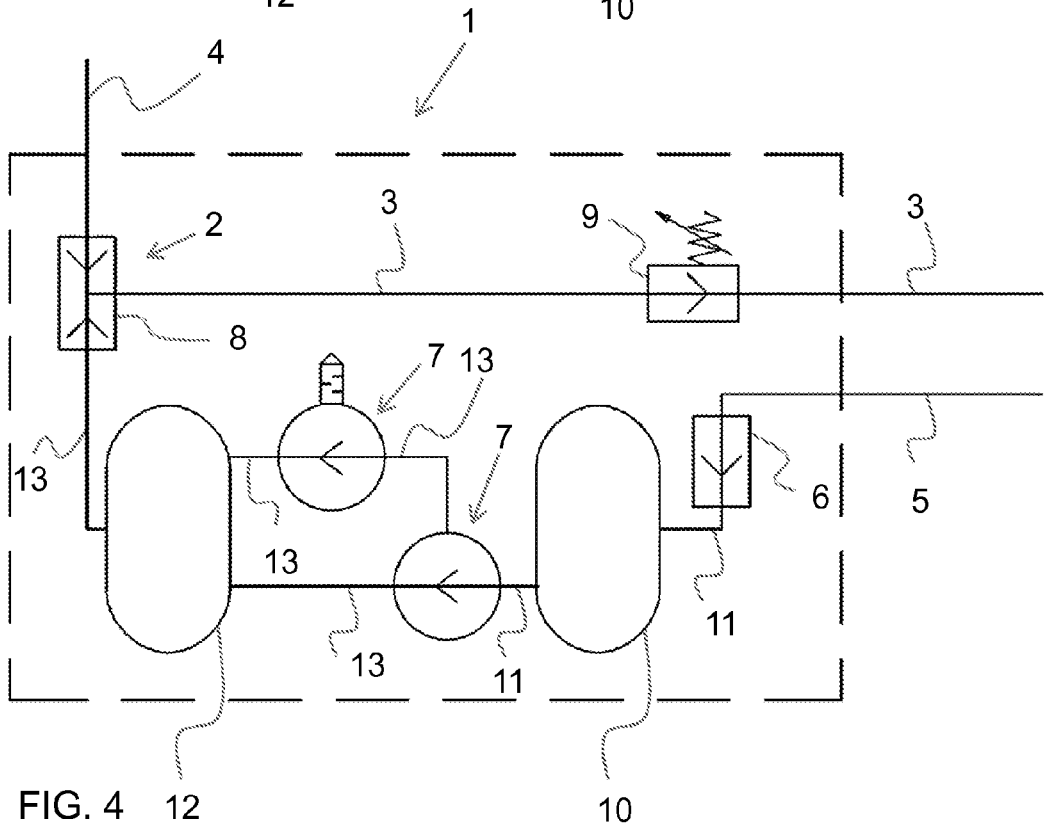
FIG. 4 shows a schematic structure of a fourth embodiment of the pressure-increasing unit.

FIG. 4 shows a fourth embodiment of the pressure-increasing unit 1. Therein, the gas that has released its energy in the first pressure intensifier 7 is conveyed to the second pressure intensifier in order to further intensify its pressure, enabling the total efficiency of the pressure-increasing unit to be enhanced. The pressure-increasing unit 1 thus comprises two successive pressure intensifiers 7. In this embodiment, the gas moves from each pressure intensifier directly to the substitution means 8, or is stored according to FIG. 4 in the second storage tank 12.

It will be apparent to a person skilled in the art that as technology advances, the basic idea of the invention may be implemented in many different ways. The invention and its embodiments are thus not restricted to the examples described above but may vary within the scope of the claims.

The invention claimed is:

1. A pressure-increasing unit (1), comprising:

a first receiving means (2) configured to be connected to a pipeline (4) conveying pressurized gas from a main source, wherein the first receiving means receives the pressurized gas from the main source via the pipeline (4), and at least one first pipeline (3) connected to the first receiving means and for further transferring the pressurized gas from the first receiving means to a gas-utilizing object that utilizes the pressurized gas from the main source, and a second receiving means (6) configured to be connected to a second pipeline (5) conveying reduced-pressure gas returning from the gas-utilizing object, a pressure intensifier (7) disposed downstream from the second receiving means (6), wherein the pressure intensifier receives the reduced-pressure gas received by the second receiving means and re-pressurizes the reduced-pressure gas by utilizing energy contained in the gas flow returning from the gas-utilizing object, and a substitution means (8) disposed downstream from the pressure intensifier (7) so as to receive the re-pressurized gas from the pressure intensifier (7) and that connects to the first receiving means (2) that receives the pressurized gas from the main source, so that the re-pressurized gas is transferred from the pressure intensifier (7) back to the gas-utilizing object via the first pipeline (3), wherein the substitution means (8) is disposed between the pipeline (4) conveying pressurized gas from the main source and the first pipeline (3), and when the pressure of the re-pressurized gas received from the pressure intensifier (7) is higher than the pressure of the pressurized gas received from the pipeline (4), the substitution means cuts off a flow of the pressurized gas coming from the main source via the pipeline (4), and the re-pressurized gas moves through the substitution means to the gas-utilizing object via the first pipeline (3), wherein the pressure-increasing unit is separable from the main source, and disposed downstream from the main source and upstream from the gas-utilizing object for re-pressurizing and recycling the reduced pressure gas recovered from the gas-utilizing object.

2. The pressure-increasing unit as claimed in claim 1 further comprising a first storage tank (10) arranged in a third pipeline (11) interconnecting the second receiving means (6) receiving the reduced-pressure gas and the pressure intensifier (7).

3. The pressure-increasing unit as claimed in claim 2, wherein the gas that has released energy in the pressure intensifier and is thereafter released by the pressure intensifier, is arranged to be conveyed to the first storage tank (10).

4. The pressure-increasing unit as claimed in claim 1, further comprising a second storage tank (12) arranged in a fourth pipeline (13) interconnecting the pressure intensifier (7) and the substitution means (8).

5. The pressure-increasing unit as claimed in claim 1, further comprising a pressure controller (9) arranged in the first pipeline (3) for further transferring the pressurized gas to the gas-utilizing object.

6. The pressure-increasing unit as claimed in claim 1, wherein the second receiving means (6) for receiving the reduced-pressure gas comprise a check valve.

7. The pressure-increasing unit as claimed in claim 1, wherein the pressure intensifier (7) comprises two or more pressure intensifiers (7).

8. The pressure-increasing unit as claimed in claim 7, wherein the pressure intensifiers (7) are installed in series.

* * * * *